US005083106A

United States Patent [19]

Kostusiak et al.

[11] Patent Number: 5,083,106

[45] Date of Patent: Jan. 21, 1992

[54] INTRUDER DETECTION SYSTEM WITH PROGRAMMABLE COUNTDOWN TIMER FOR SELF-SUPERVISION

[75] Inventors: Karl H. Kostusiak, Pittsford; William S. Dipoala, Fairport, both of N.Y.

[73] Assignee: Detection Systems, Inc., Fairport, N.Y.

[21] Appl. No.: 653,188

[22] Filed: Feb. 11, 1991

[51] Int. Cl.[5] ..... G08B 29/00

[52] U.S. Cl. ..... 340/506; 340/522; 340/527; 340/541

[58] Field of Search ..... 340/501, 506, 509, 517, 340/522, 523, 526, 527, 528, 541, 309.15

[56] References Cited

U.S. PATENT DOCUMENTS 4,622,539 11/1986 Buss et al. ..... 340/506

4,660,024 4/1987 McMaster ..... 340/506

*Primary Examiner*—Jin F. Ng

*Assistant Examiner*—Nader Sayegh

*Attorney, Agent, or Firm*—Warren W. Kurz

[57] ABSTRACT

An intruder detection system includes a self-supervision feature which, on the basis of detecting authorized pedestrian traffic within a region under surveillance, alerts the system user of potentially faulty system components. Such system comprises a programmable timer which is repeatedly reset to a programmed maximum time interval by each occurence of an alarm-producing event, such as a disturbance of standing microwaves and/or a slight increase in ambient temperature in a region under surveillance. During "disarm" periods when the system alarm is intentionally deactivated to enable use of the protected region without the production of any alarm signals, each occurence of an alarm input to the system alarm (as produced by authorized traffic within the protected region) is used to repeatedly reset the timer to its preselected time interval (e.g., 1,4,8 or 16 days). In the absence of an alarm input within the programmed time interval, the timer times out and activates a "trouble" alarm, alterting the system user of a potential sensor failure. Preferably, the timer's countdown is halted or interrupted during periods when the system is "armed".

7 Claims, 2 Drawing Sheets

INTRUDER DETECTION SYSTEM WITH PROGRAMMABLE COUNTDOWN TIMER FOR SELF-SUPERVISION

BACKGROUND OF THE INVENTION

The present invention relates to the field of intrusion detection. More particularly, it relates to improvements in intrusion detection systems of the type which passively monitor or "supervise" the operating status of the intrusion sensor components to assure that each sensor is, indeed, functioning properly and, hence, capable of detecting intrusion.

An intrusion detection system in which the various intrusion-sensing elements are non-functioning is, of course, of psychological value only. Obviously, in an detection system, the level of security depends on the percentage of sensors which are functioning at any given time. Since a non-functioning sensor is not easy to detect without actually "walk-testing" the sensor to determine whether it produces an alarm output, it is becoming increasingly common to incorporate a so-called "supervisory" circuit in such systems to monitor the operating status of certain sensor components which are particularly prone to fail, such as the Gunn diode in a microwave detection system. In the event of a component failure, such circuits operate to activate a "supervisory" or "trouble" alarm (e.g., a light-emitting diode) to alert the user of the problem. Detection systems incorporating such supervisory circuits are disclosed, for example, in the commonly assigned U.S. Pat. No. 4,660,024 to R. L. McMaster.

In the commonly assigned U.S. application Ser. No. 492,482, filed on Mar. 12, 1990 in the name of W. S. Dipoala and entitled ACTIVE SUPERVISION OF MOTION DETECTION SYSTEMS, there is disclosed a dual-technology (passive-infrared/microwave) intruder detection system in which both sensor components are "actively" supervised by periodically simulating, within the system, a target of interest. In the event either sensor fails to detect the simulated target, a supervisory alarm is produced. While such "active" supervision provides optimal protection against sensor failure, it does so at the expense of requiring target-simulation apparatus within each sensor device.

Recently, it has become known to "passively" supervise the detection capability of intrusion sensors by monitoring the pedestrian-produced activity of the sensors during those periods when the system is "disarmed", e.g., during the daylight hours in which the protected premises are being used by the owner of the system and the alarm has been inactivated. In a multisensor system, the sueprvisory apparatus usually includes a display which indicates which of the several sensors have been activated or "tripped" during the disarm period and, hence, are functional; it also, of course, indicates those which have not been activated. To prevent the system from being re-armed without having the operability of those non-activated sensors verified (e.g., by walk-testing), it is common for the supervisory circuit to inhibit re-arming until it detects that all sensors have been activated. While this arrangement provides a high degree of security, it can be a nuisance to a user who, for example, arms the system after verifying that all sensors are functional and then realizes that he forgot something inside the protected premises. To re-enter such premises, even for a moment, means that he must walk-test all sensors, since there is no intervening traffic to do this job for him. Because of this inconvenience, there is some reluctance on the part of the security customer to opt for this very effective passive supervisory feature.

In the commonly assigned U.S. application Ser. No. 576,055, filed on Aug. 31, 1990 in the names of J. Berube et al., now U.S. Pat. No. 5,057,817 entitled INTRUDER DETECTION SYSTEM WITH PASSIVE SELF-SUPERVISION, there is disclosed an intrusion detection system which overcomes the above-mentioned disadvantage. Such a system is re-armable if either of two conditions prevail, namely, (a) all of the intrusion sensors have been activated during the disarm period, or (b) an attempt to re-arm occurs within a relatively brief, predetermined time interval (e.g., within one hour) immediately following disarming of the system. The latter condition is provided by a programmable timer which provides a continuous signal for a predetermined time interval each time a disarm signal is produced by the system user. Preferably, the timer output, together with the output of the system's supervisory circuit (indicating that all sensors have been activated during the disarm period) serve as the input to a logical OR gate which provides an arm-enabling signal whenever either of its inputs is present. By this arrangement, the system owner/user may re-enter the protected premises after disarming the system and, so long as the system is re-armed within the pre-set period established by the timer, he need not walk-test all sensors prior to rearming.

Form any "low security" applications, the requirement that the system user verify the operating status of each intrusion sensor prior to arming the system is too burdensome for system user. Even with the assistance of authorized traffic in the protected region, the owner must still assure that each sensor is functional every time he attempts to arm the system. As indicated above, when the system is armed for only a brief period, many of the sensors in a multisensor system will not be activated by authorized traffic, requiring the user to walk-test all non-activated sensors.

SUMMARY OF THE INVENTION

In view of the foregoing discussion, an object of this invention is to provide a self-supervised intrusion detection system in which the activation of the sensor(s) is not required during each disarm period, but rather, is required within a predetermined time interval following its most recent activation.

The intruder detection system of the invention is characterized by a programmable timer which is set at any one of a plurality of different time intervals, e.g., 1,4,8 or 32 days. If, during a user-chosen time interval established by the timer, a particular sensor has not been activated, the timer "times-out" and produces a "trouble" alarm-activating signal which may be used, for example, to pulse a light-emitting diode (LED) to alert the system user that this particular sensor is potentially faulty. If, on the other hand, such sensor is activated during the chosen time interval, its alarm output signal is used to reset the timer to the time interval chosen, beginning the timer's countdown anew. According to a preferred embodiment, the timer's countdown of the chosen time interval is halted (i.e. suspended) during those periods in which the system is "armed". Thus, by virtue of the present invention, it is not necessary for a sensor to be activated during each disarm period in order for the system to be re-armed. Rather, it need be activated only during a time interval chosen by the user which may encompass several disarm periods. An advantage of the invention is that the user is not burdened with the "walk tests" mentioned above. Also disclosed is a dual-technology system which embodies the countdown feature of the invention. According to a preferred embodiment such system defaults to a single-technology system in the event the timer "times-out".

The invention and its various advantages will become better understood from the ensuing detailed description of preferred embodiments, reference being made to the accompanying drawings.

DETAILED DESCRIPTION OF PREFERRED EMBODIMENTS

Figure 1:
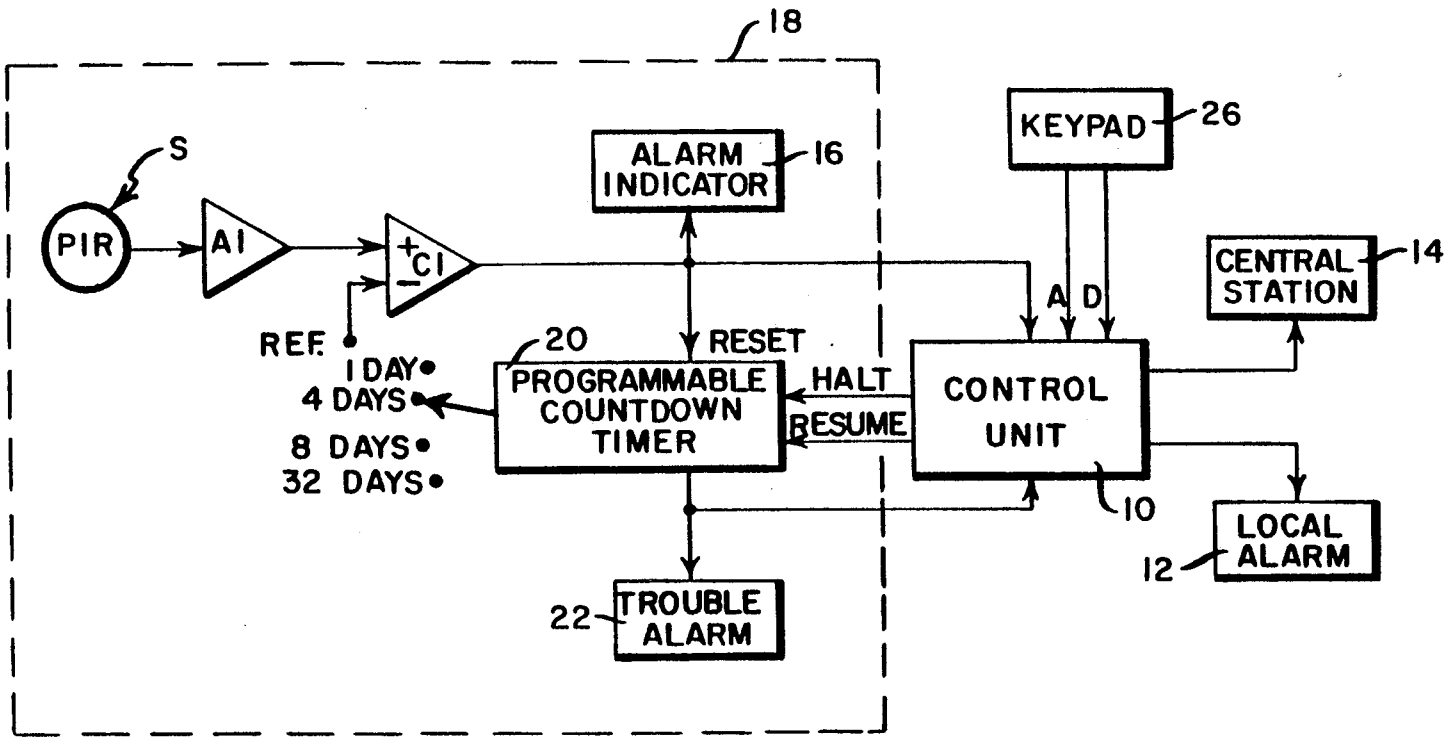
FIG. 1 is a schematic illustration of a single sensor intruder detection system embodying the present invention.

Referring now to the drawings, FIG. 1 schematically illustrates a single sensor intruder detection system embodying the invention. Such system comprises an intrusion sensor S, in this case a passive infrared (PIR) detector, which is adapted to detect small changes in temperature as produced by the body heat of an intruder moving through its field of view. The output of sensor S is amplified by preamplifier A1 and threshold detected by comparator C1. When the output of the sensor exceeds a certain threshold level set by a reference voltage REF, the comparator produces an alarm output which is fed to a control unit 10. When the system is "armed", the control unit may act on such input signal to activate a local alarm 12 and/or notify a central monitoring station 14 of the alarm condition. When the system is "disarmed", the control unit will ignore any alarm input signal from the sensor. Optionally, the alarm output from comparator C1 may be used to energize an alarm indicator 16 (e.g. an LED) for a predetermined time interval. The alarm indicator is usually mounted on the sensor housing 18 which contains the intrusion sensor and its electronics.

In accordance with the present invention, sensor S has associated therewith a programmable countdown timer 20 which, upon being set by the system user to one of a plurality of selectable time intervals (shown as 1,4,8 ; and 32 days) begins to countdown the chosen time interval. As shown, timer 20 is provided with a reset terminal which is connected to the alarm output of comparator C1. Thus, each time the comparator produces an alarm output , the timer's countdown is reset to the chosen time interval. In the event the timer "times-out", i.e., no reset signal is received within the chosen time interval, the timer produces an output signal which activates a "trouble" alarm 22 (e.g, an LED) and notifies the control unit of a potential sensor failure.

In use, the system is "armed" in a conventional manner by a user-operated keypad 26 which transmits an "arm" signal A to the control unit. The "arm" signal has the effect of enabling the control unit to respond to an alarm input (from comparator C1) in order to sound the local alarm and/or telephone central monitoring station 14. Disarming of the system is also effected by the keypad by causing it to transmit a "disarm" signal D. The "disarm" signal, of course, renders the control unit non-responsive to alarm inputs. Preferably, whenever the system is "armed", the control unit transmits a "halt" signal to timer 20 which serves to suspend the timer's countdown at whatever time in the count the "halt" signal is received. In such case, a count "resume" signal is provided to the timer when the system is again "disarmed".

In chosing the countdown time interval of timer 20, the user must assess his security needs, the normal traffic flow through the field of view of the sensor during "disarm" periods, and the length of the "disarm" periods vis-a-vis the "arm" periods. Generally, the shorter the time interval chosen, the earlier the user will be notified of a sensor failure. But this depends on the pattern and frequency of authorized traffic in the region under surveillance, and the ratio f "arm" periods to "disarm" periods. For example, in a warehouse application where the system is "disarmed" for a short time, say, about 1 hour, each day, and there is no normal (i.e., authorized) traffic flow through the field of view of the sensor, one would not be apt to chose the =day time interval for timer 20. This is especially true if the "halt" feature is used for, in the event of sensor failure, it could take months for the timer to "time-out" and produce a "trouble" alarm. On the other hand, in a home setting where the system is "armed" for only a few hours per day, the 32 day time interval may be desirable; if, for example, the home owner chooses a 1 day period, he may find it overly burdensome to have to make frequent "walk-tests" of remotely located sensors. The trade-off, of course, is security versus convenience.

Figure 2:
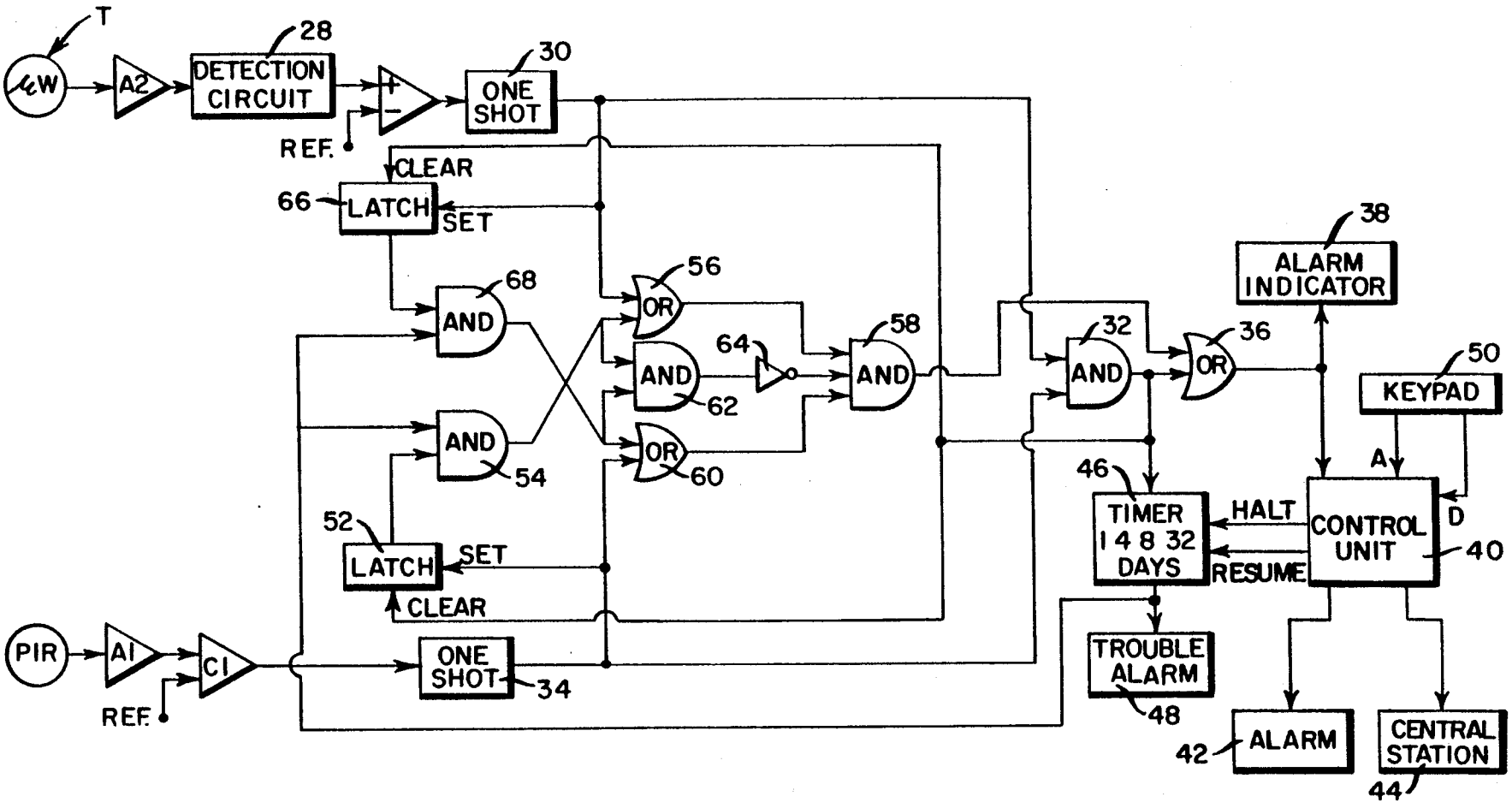
FIG. 2 is a schematic illustration of a dual-technology intruder detection system embodying the invention.

Referring now to FIG. 2, there is illustrated a so-called "dual technology" intruder detection system which embodies the present invention. Such system is adapted to sound an alarm only in the event intrusion is sensed substantially simultaneously by two sensors which operate on different technologies (e.g., microwave and passive-infrared technologies). Such systems are far more immune to false alarming, for obvious reasons. The FIG. 2 system includes the above described FIG. 1 components, including the sensor S, amplifier A1, and comparator C1 components; it further comprises a microwave transceiver T, an amplifier A2 connected to the transceiver output, a detection circuit 28, and a comparator C2. The microwave component may be of the well-known Doppler variety, and it suffices to say that comparator C2 produces an alarm output when the Doppler signal (produced by the detection circuit 28) has certain frequency and amplitude characteristics.

When the microwave component produces an alarm signal, a pulse of a predetermined time interval is produced by a one-shot (monstable multivibrator) 30. The output of one-shot 30 provides one of the two inputs to AND gate 32. The other input to AND gate 32 is provided by one-shot 34 which is triggered by the alarm output from the PIR comparator C1. Thus, when intrusion is sensed by both sensors within the time periods established by their respective one-shots, a "dual alarm" output is produced by AND gate 32. After passing through an OR gate 36 (discussed below) this alarm output signal activates an alarm indicator 38 and provides an alarm input to the control unit 40. The latter, as described above, activates a local alarm 42 and/or notifies a central monitoring station 44 of an alarm condition.

In accordance with the present invention, the dual-tech system of FIG. 2 includes a programmable countdown timer 46 which is resettable by the alarm output of AND gate 32. Timer 46 performs the same function as described above with reference to the FIG. 1 embodiment. As in the case of the FIG. 1 embodiment, if the timer "times-out" before receiving a dual alarm input from AND gate 32, it provides a "trouble" alarm 48, alerting the user of a potential sensor failure. Arming and disarming of the system is provided by a keypad 50, as described above. The remaining circuitry, described below, enables the dual-tech system to default to a "single" technology system in the event only one of the two intrusion-sensing components has produced an alarm output, and the timer has "timed-output". Such circuitry operates in the following manner:

Assume that the PIR component has produced an alarm output and the microwave component has not. While this situation may result from a false alarm produced by the PIR component, the system logic assumes the that the sensor component which has not alarmed (in this case the microwave component) has failed. As shown, when the PIR component produces an alarm output, the output of the PIR's one-shot 34 acts to set a latching circuit 52 so that it provides a continuous input to an AND gate 54. The other input to AND gate 54 is provided by the "trouble" alarm output of timer 46 which, of course, is produced when the chosen time interval has expired. So long as the timer has not "timed-out", there is no output from AND gate 54, and the system continues to operate in the dual-tech mode. Note, where a dual alarm signal produced by AND gate 32 before the timer "timed-out", latch 52 would be cleared by virtue of the connection between the output of AND gate 32 and the "clear" input to latch 52. If no such dual alarm signal is produced and the timer "times-out", AND gate 54 produces an output which passes through an OR gate 56 to one of three inputs of an AND gate 58. When all three inputs to AND gate 58 are "high", it provides a "default" alarm signal which passes through OR gate 36 and is acted upon by control unit 40 to activate the main alarm 42. The other inputs to AND gate 58 are provided by the output of an OR gate 60, and the inverted output of an AND gate 62. It will be appreciated that OR gate 60 produces an output when either the microwave or PIR component alone produces an alarm output. Thus, assuming that the microwave component has failed, the second alarm output of the PIR component alone will provide a second "high" input to AND gate 58. The third input to AND gate 58 is normally "high" by virtue of the normally "high" output of inverter 64. Only in the event AND gate 62 goes "high", and this occurs only in the event non-simultaneous alarm outputs are provided by the PIR and microwave components, will the output of inverter be "low". The combination of AND gate 62 and inverter 64 prevents the system from defaulting to a "single-technology" system when there is insufficient data to justify such action.

From the above description, it will be appreciated that the microwave latch 66 and AND gate 68 are functional when the microwave component is operational and the PIR component has failed. It also will be appreciated that the dual-tech system of FIG. 2 affords the same advantages as the FIG. 1 embodiment, with the additional advantage that, in the event the chosen time interval of timer 46 expires, the system defaults to a single -tech system, i.e., to the still functoning component. It should be noted that the dual-tech system of FIG. 2 will default to a single-tech system not only in the case of a technical failure of one sensor component, but whenever one of the two components is compromised, as would occur if, for example, the PIR component were intentionally or inadvertantly masked.

While the invention has been described with reference to preferred embodiments, it will be appreciated that many modifications can be made without departing from the spirit and scope of invention, as defined by the appended claims.

What is claimed is:

1. An intruder detection system comprising:

(a) an intrusion sensor for detecting intrusion in a region of interest, said sensor being adapted to produce a sensor output signal upon detecting intrusion;

(b) intrusion alarm means operatively coupled to said sensor and responsive to said sensor output signal for producing an intrusion alarm;

(c) a programmable countdown timer for counting-down a preselected time interval and for producing a timer output signal at the end of said preselected time interval, said programmable countdown timer being responsive to said sensor output signal to reset the time remaining in the countdown when said sensor output signal is produced to the maximum length of said preselected time interval; and (d) supervisory alarm means, responsive to said timer output signal, for producing a supervisory alarm in the event said sensor output signal is not produced within said preselected time interval.

2. The apparatus as defined by claim 1 further comprising arm/disarm means for selectively rendering said intrusion alarm means responsive and non-responsive to said sensor output signal, said timer being responsive to said arm/disarm means to halt the countdown of said preselected time interval whenever said intruder alarm means is responsive to said sensor output signal.

3. The apparatus as defined by claim 1 wherein said programmable countdown timer can be programmed to any one of a plurality of time intervals.

4. An intruder detection system comprising:

(a) first and second intrusion sensors for sensing intrusion in a region of interest and for producing first and second sensor output signals, respectively, in response to sensing intrusion in said region of interest;

(b) circuit means operatively coupled to said first and second intrusion sensors for producing an intrusion alarm signal in the event said first and second sensor output signals are produced substantially simultaneously;

(c) intrusion alarm means normally responsive to said intrusion alarm signal to produce an intrusion alarm;

(d) a programmable countdown timer for counting-down a preselected time interval and for producing a timer output signal at the end of said preselected time interval, said programmable countdown timer being responsive to said first and second sensor output signals being produced substantially simultaneously to reset the time remaining in the countdown when said sensor output signal is produced to the maximum length of said preselected time interval; and (e) supervisory alarm means, responsive to said timer output signal, for producing a supervisory alarm in the event said first and second sensor output signals are not produced substantially simultaneously within said preselected time interval.

5. The apparatus as defined by claim 4 further comprising arm/disarm means for selectively rendering said intrusion alarm means responsive and non-responsive to said intrusion alarm signal; said timer being responsive to said arm/disarm means to halt the countdown of said preselected time interval whenever said intruder alarm means is responsive to said intrusion alarm signal, and to resume the countdown whenever said intruder alarm means is non-responsive to said intrusion alarm signal.

6. The apparatus as defined by claim 4 wherein said programmable countdown timer can be programmed to any one of a plurality of time intervals.

7. An intruder detection system comprising:

(a) first and second intrusion sensors for sensing intrusion in a region of interest and for producing first and second sensor output signals, respectively, in response to sensing intrusion in said region of interest;

(b) circuit means operatively coupled to said first and second intrusion sensors for producing an intrusion alarm signal in the event said first and second sensor output signals are produced substantially simutaneously;

(c) intrusion alarm means normally responsive to said intrusion alarm signal to produce an intrusion alarm;

(d) a programmable countdown timer for counting-down a preselected time interval and for producing a timer output signal at the end of said preselected time interval, said programmable countdown timer being responsive to said first and second sensor output signals being produced substantially simultaneously to reset the tine remaining in the countdown when said sensor output signal is produced to the maximum length of said preselected time interval;

(e) supervisory alarm means, responsive to said timer output signal, for producing a supervisor alarm in the event said first and second sensor output signals are not produced substantially simultaneously within said preselected time interval; and (f) logic circuitry for enabling said intrusion alarm means to respond to one of said first and second sensor output signals in the event said one sensor output signal is produced without the other sensor output signal, and said timer output signal has been produced.

* * * * *